US007370860B2

(12) United States Patent
James, III et al.

(10) Patent No.: US 7,370,860 B2
(45) Date of Patent: May 13, 2008

(54) AUTOMATIC EDGE GUIDE ASSEMBLY USING SPRINGS AND TAPERED SURFACES

(75) Inventors: Edmund H. James, III, Lexington, KY (US); Randal S. Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 334 days.

(21) Appl. No.: 10/955,535

(22) Filed: Sep. 29, 2004

(65) Prior Publication Data

US 2006/0066705 A1 Mar. 30, 2006

(51) Int. Cl.
*B65H 1/00* (2006.01)

(52) U.S. Cl. ..... 271/171; 271/169; 271/170

(58) Field of Classification Search ..... 271/171, 271/145, 169, 170
See application file for complete search history.

(56) References Cited

U.S. PATENT DOCUMENTS 2,270,871 A * 1/1942 Felber ..... 271/143
2,887,208 A * 5/1959 Cross ..... 400/629
2,961,947 A * 11/1960 Springer ..... 101/132
3,520,533 A * 7/1970 Phleps et al. ..... 271/127
3,768,805 A * 10/1973 Kuksa ..... 271/126
4,273,457 A 6/1981 Noda
4,330,114 A * 5/1982 Coombs et al. ..... 271/22
4,514,740 A 4/1985 Fujiwara et al.
4,569,468 A * 2/1986 Neer ..... 226/74
4,697,804 A * 10/1987 Pollich ..... 271/162
5,277,506 A 1/1994 Oda
5,327,206 A * 7/1994 Ueda et al. ..... 399/402
5,454,648 A 10/1995 Lee
5,931,456 A * 8/1999 Laidlaw ..... 271/171
RE37,157 E * 5/2001 Ikeda et al. ..... 399/124
6,793,215 B2 * 9/2004 Salomon ..... 271/171
2002/0179624 A1 12/2002 Tramontina

FOREIGN PATENT DOCUMENTS

EP 0443590 A1 2/1990

* cited by examiner

*Primary Examiner*—Patrick Mackey
*Assistant Examiner*—Gerald W McClain
(74) *Attorney, Agent, or Firm*—Middleton Reutlinger

(57) ABSTRACT

An automatic edge guide assembly comprises a sheet feeding mechanism, a slide housing mounted within the sheet feeding mechanism and an edge guide slidably connected to the slide housing. The edge guide is biased by a first biasing force and a second biasing force, wherein the first force is greater than the second force, allowing for automatic edge alignment within a predetermined range of widths.

27 Claims, 8 Drawing Sheets

AUTOMATIC EDGE GUIDE ASSEMBLY USING SPRINGS AND TAPERED SURFACES

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None.

BACKGROUND

1. Field of the Invention

The present invention provides an automatic edge guide for a peripheral device. More specifically, the present invention provides an automatic edge guide which aligns the edges of media being loaded into the peripheral device by urging the media against an opposed stationary guide member.

2. Description of the Related Art

Digital photo printing has increased in popularity in recent years due to the increased popularity of digital cameras. Generally, digital cameras convert an optical image to a digital image through a charge-coupled device (CCD) image sensor or the like. The digital image may then be saved to an image memory for further data processing. In recent years digital camera features have improved significantly. For example, digital camera resolutions and memory storage capabilities have increased while prices for such features have steadily decreased, leading to increased digital camera sales. One perceived drawback associated with digital cameras is that users do not like printing digital images on standard printing paper. Instead, users want pictures printed having the look, feel and size of photos developed by professional developers. In order to overcome this perceived drawback of digital photography, manufacturers have developed various photo printers which print the digital images to media comparable to professionally developed photos.

However, one problem commonly realized with such photo printers, as well as other peripheral devices, is alignment of the edges of the photo media in the media pick feed mechanism. When edges of the photo media are misaligned, skewing results and the printed image may not be aligned properly on the photo media. Prior art devices have utilized slidable guides which are typically manually manipulated in order to properly adjust for media of varying sizes.

SUMMARY OF THE INVENTION

In a peripheral device an automatic edge guide assembly comprises a slide housing mounted within the device and an edge guide slidably connected to the slide housing. The edge guide is biased by a first biasing force and a second biasing force, wherein the first force is greater than the second force allowing for automatic edge alignment of media within a predetermined range of widths. The edge guide assembly further comprises said edge guide having a tapered lead-in surface for media being inserted into the assembly. The first and second biasing forces are created by an upper spring and a lower spring wherein the upper spring has a larger spring force than said lower spring. In a further embodiment a sheet feeding mechanism is provided in the assembly.

The slide housing has upper and lower apertures defining one or more collars or spring housings. Extending from each spring housing is a guide which is co-axially aligned with the spring housings and has a smaller diameter than the corresponding spring housings.

Opposite the slide housing is an edge guide having first and second posts extending from the edge guide and through the slide housing. At distal ends of the posts are locking protuberances which extend through the guide and locks the edge guide to the slide housing. Disposed over each post is a spring seated at one end within the spring housing and at an opposite end against the edge guide. The springs provide a biasing force on the edge guide. The edge guide further comprises a tapered lead-in which is engaged by a media stack and creates a component force to push against the first and second springs. Opposite the edge guide assembly is a stationary edge guide which engages the edge media stack opposite the edge guide assembly. The edge guide further comprises a pick plate extending substantially perpendicularly from the edge guide and aiding in sheet feeding. The edge guide translates relative to the slide housing substantially perpendicular to the direction of media movement through the feed mechanism.

DETAILED DESCRIPTION

Referring now in detail to the drawings, wherein like numerals indicate like elements throughout the several views, there are shown in FIGS. 1-8 various aspects of an automatic edge guide assembly. The assembly automatically aligns media of a predetermined range of sizes disposed in a media input to inhibit skewing without causing undue drag and the like.

Figure 1:
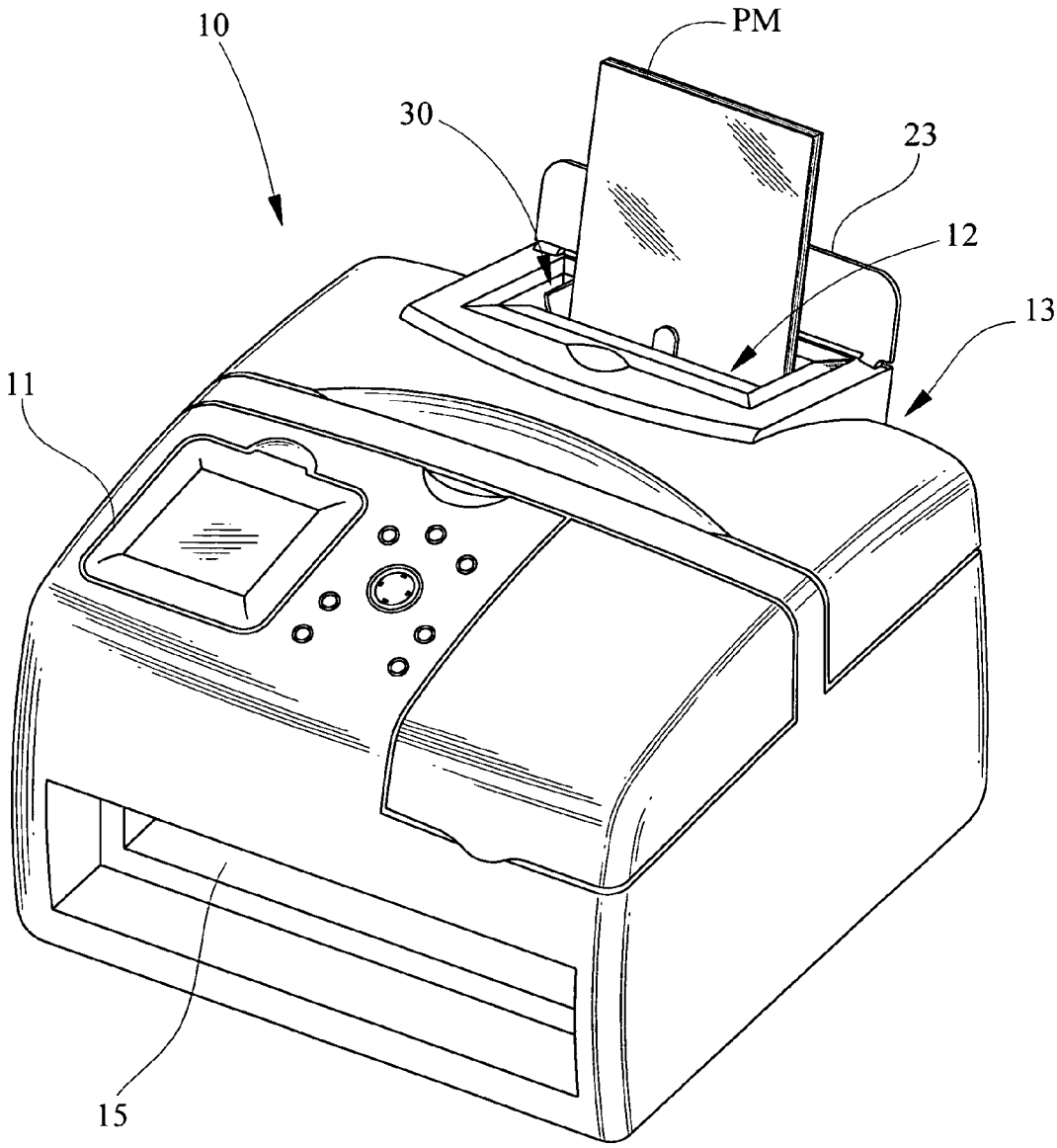
FIG. 1 is a perspective view of an illustrative photo printer peripheral device.

Referring initially to FIG. 1, a peripheral device 10 is shown and described for printing photos on to small photo media PM of a preselected size. The photo media PM described herein may include but is not limited to Hagaki media, 4"×6" photo sheets, or A6 media. As used herein media means any media, such as photo media, having a preselected width that can be accommodated by the edge guide assembly provided in the peripheral device and is merely referred to as photo media since the device is described in the context of a photo printer. However one of ordinary skill in the art will understand, upon reading of the instant specification, that the automatic edge guide assembly 30 may be utilized with a standard size printer or multifunction peripheral for printing to alternate media sizes including, but not limited to, letter size media, A4 media or the like. The peripheral device 10 is defined by a housing 13 generally having a plurality of sides. Along an upper surface of the peripheral device 10 a control panel 11 includes a plurality of buttons for making selections. The control panel 11 can also include a graphics display to provide a user with menus, choices or errors occurring with the system. Along an upper surface of the housing 13 is a media input 12 while a front surface of the housing 13 comprises a media output 15. This configuration is defined as an L-path feed system since, when viewed from a side, the path of the photo media is substantially L-shaped. Although the edge guide device is generally shown and described herein for use with an L-path media feed system, it is well within the scope of the present invention that the edge guide device may be utilized with a C-path feed system.

Figure 2:
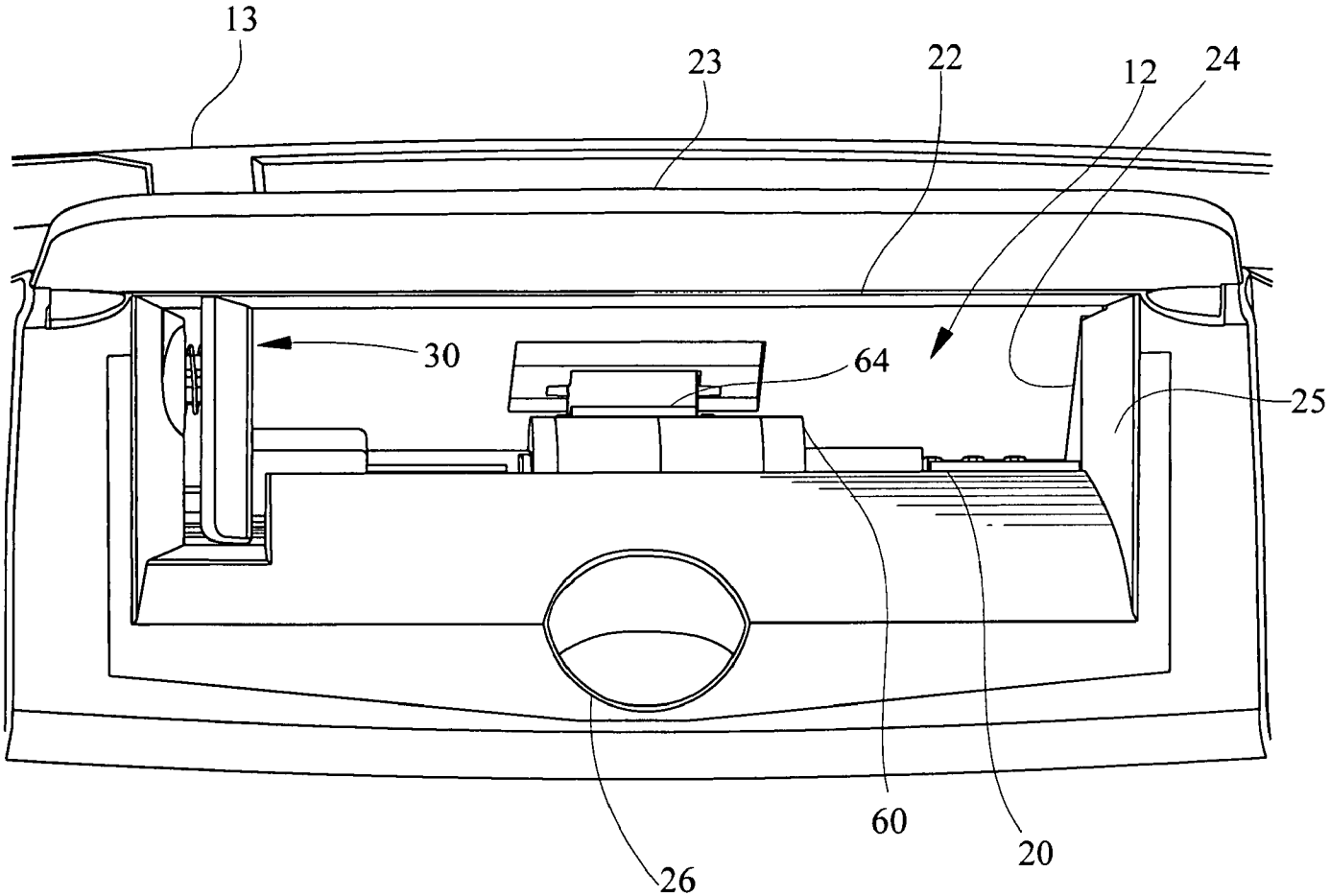
FIG. 2 is a top view of a portion of the peripheral of FIG. 1, including the edge guide assembly of the present invention.

Referring now to FIG. 1 and FIG. 2, wherein a top view of the peripheral device 10 is depicted, the paper input 12 is shown surrounded by portions of the housing 13. The paper input 12 is defined by a front wall 20, a rear wall 22, a stationary edge guide member 24 and a automatic edge guide assembly 30 forming an opening for receiving print media, such as photo quality media. The automatic edge guide assembly 30 moves laterally parallel to the front wall 20 and rear wall 22 in order to force photo media positioned in the paper input 12 toward a vertical wall of the stationary edge guide member 24 in order to align the edges of the photo media (FIG. 1). More specifically, the edge guide assembly 30 translates laterally due to a spring bias in a direction substantially normal to the direction of media feed into the paper input 12. Through such movement, parallel edges of the media stack are aligned on one edge by the stationary guide member 24 and on an opposite edge by the automatic edge guide assembly 30. As previously indicated, the present device may be used specifically with media sizes of a pre-selected size range such as Hagaki media, 4"×6" media or A6 media, which are all within 5 mm in width of one another. Thus, according to one exemplary embodiment the edge guide assembly 30 need only have a limited range of movement, in this case about 5 mm, although one skilled in the art will realize that alternate size ranges may be implemented. The stationary edge guide member 24 includes a tapered lead-in surface 25 in order to direct any stray media sheets into the paper input 12.

Adjacent the rear wall 22 is a paper support 23 which may be rotated downward to cover the opening defining the paper input 12. The paper support 23 is rotatably connected to the housing 13 and includes at least one surface defined by, for example, four sides. In the position shown in FIGS. 1 and 2, the paper support 23 extends upwardly to support the media stack from behind in order that the media stack is supported within the paper input 12 in its substantially upright position. The housing 10 further includes an opening notch 26 wherein a user may place a finger to provide an upwardly directed force on the paper support 23 in order to move the paper support 23 from a closed position to an open upright position wherein the media input 12 can receive media for printing. The rotatable paper support 23 provides the further function of inhibiting dust, dirt, and other contaminants from entering the media input and damaging the peripheral 10.

Figure 3:
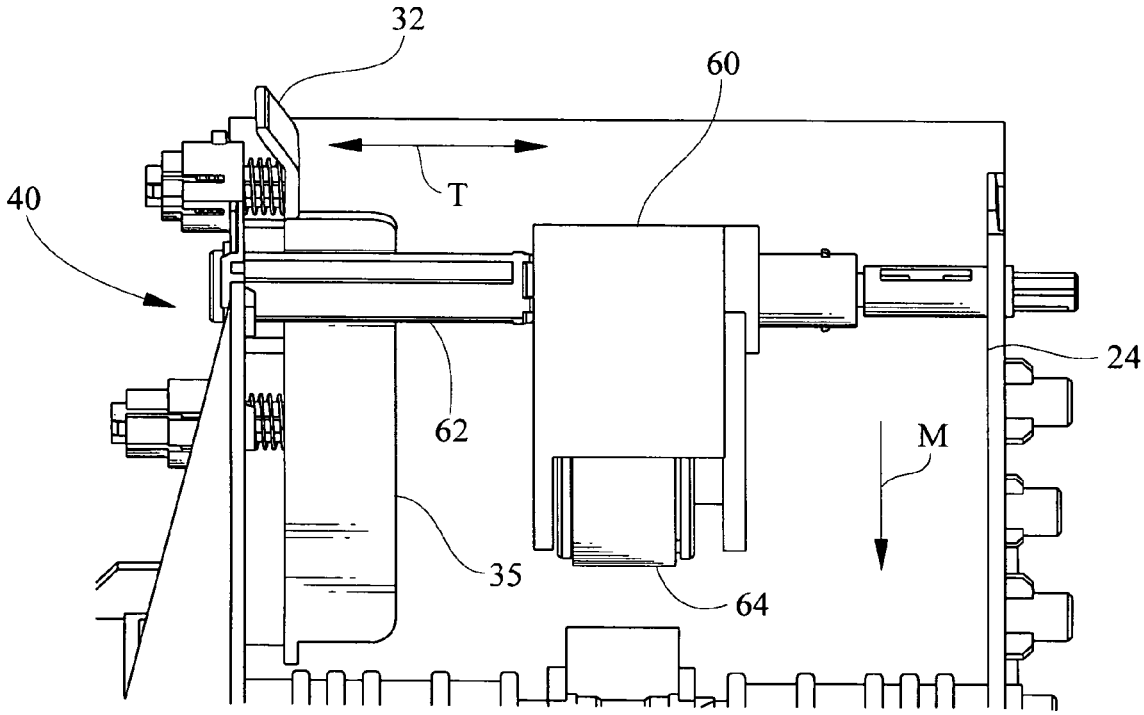
FIG. 3 is a front view of the media pick mechanism including edge guide assembly of the present invention.

Referring now to FIGS. 2-3, generally the photo media PM (FIG. 1) is picked by a paper picking mechanism, such as auto-compensating mechanism (ACM) 60, and directed downwardly by a pick tire 64 connected to the auto-compensating mechanism 60. The pick tire 64 picks print media from the media stack inserted into the paper input 12 and feeds the media toward a print zone within the peripheral 10. The auto-compensating mechanism 60 is driven preferably by a pick motor and gear train (not shown) which rotate an auto-compensating mechanism drive shaft 62 extending through the auto-compensating mechanism 60 and driving the pick tire 64 therein. When the pick motor and ACM shaft 62 rotates, torque is transferred to a pick tire drive (not shown) within the ACM 60. Specifically, the torque transmitted by the ACM shaft 62 causes the auto-compensating mechanism 60 to pivot toward the media stack and causes the pick tire 64 to rotate thereby picking the closest media sheet. During picking, the downward rotation of the auto-compensating mechanism 60 generates a normal force which is dictated by the buckling resistance of the media being picked. The normal force applied, however, is what is required to buckle a single sheet of media plus overcome the frictional resistance between the first and second sheets. Thus, when the closest media sheet moves, the normal force automatically decrease and the auto-compensating mechanism 60 delivers the normal force required to feed a single sheet of media.

The movable edge guide assembly 30 is depicted on the left hand side of the peripheral device 10. The automatic edge guide assembly 30 comprises a slide housing 40 and an edge guide 34. The slide housing 40 is mounted to the frame or other stationary portion of the peripheral 10 and provides a guide for the translational movement of the edge guide 34. The edge guide 34 is biased toward an innermost position and translates laterally relative to the slide housing 40 to urge the media stack toward an opposed stationary guide member 24. This process aligns the parallel edges of the photo media (FIG. 1) extending in a media feed direction as indicated by arrow M. The edge guide 34 further comprises a tapered lead-in surface 32 which directs photo media into the paper input 12 between the automatic edge guide assembly 30 and the opposite stationary edge guide member 24.

As depicted in FIG. 3, a front view of the peripheral 10 with the housing 13 removed reveals the substantially vertical orientation of the paper input 12 and the automatic edge guide assembly 30 in the L-path media feed. A double-headed arrow T depicts the translational movement of a portion of the automatic edge guide assembly 30, which is substantially normal to the feed direction M of the photo media. As previously indicated, the auto-compensating mechanism drive shaft 62 rotates in order to drive the auto-compensating mechanism 60 and pick tire 64 thus picking the closest sheet from the photo media stack and urging the photo media in the direction indicated by the arrow M.

Figure 4:
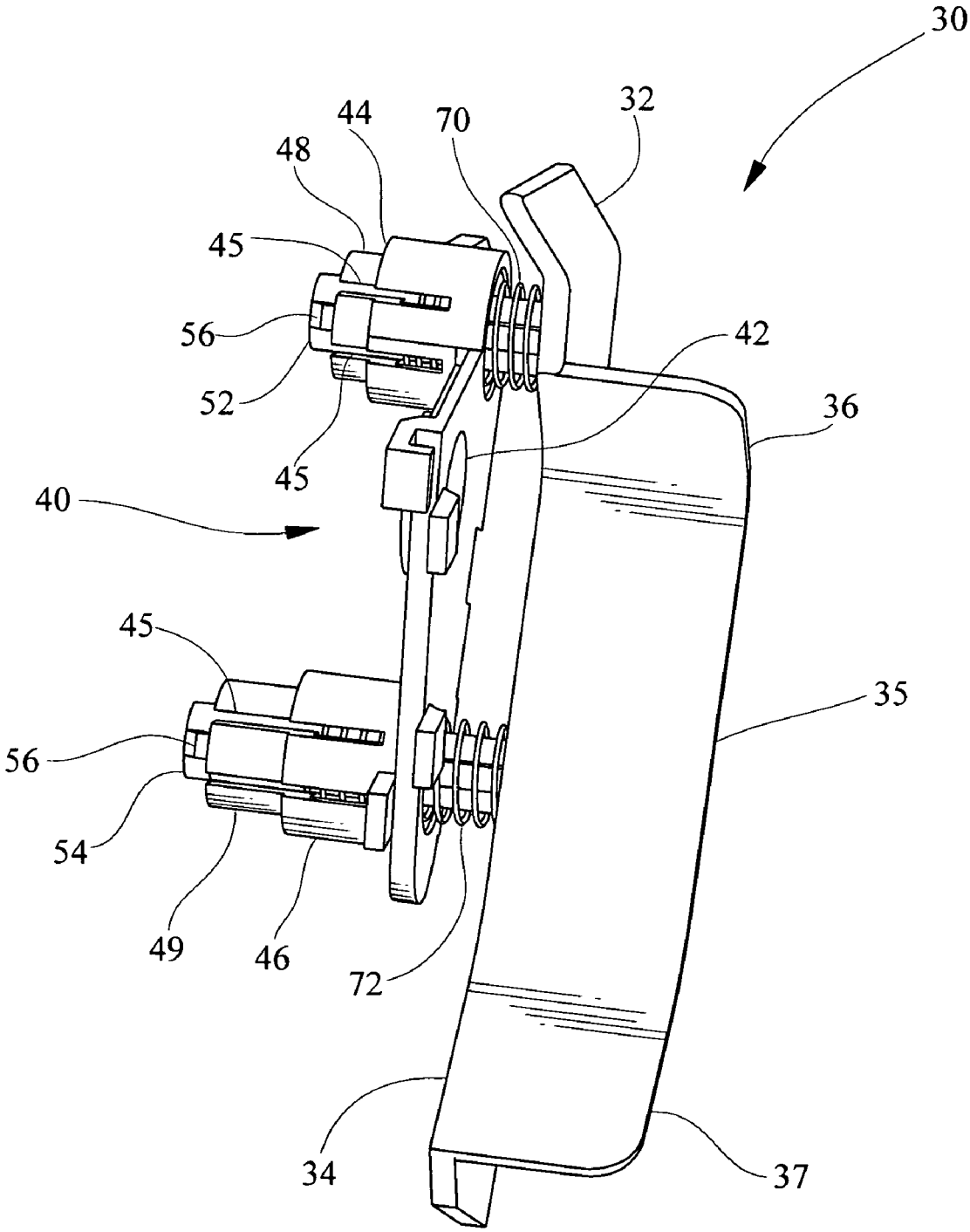
FIG. 4 is a perspective view of the edge guide assembly of FIG. 3.

Referring now to FIG. 4, the automatic edge guide assembly 30 is shown in a perspective view removed from the peripheral device 10. As previously indicated the assembly 30 comprises a slide housing 40 and a biased edge guide 34 which translates relative to a slide housing 40. The edge guide 34 further includes a tapered lead-in 32 extending upwardly and at an angle to the edge guide 34. The tapered lead-in 32 engages the media stack inserted in the media input 12. The angle of the tapered lead-in 32 and the downward force of the media stack causes a component force opposite to a spring force described herein. The edge guide 34 further comprises a pick guide 35 extending perpendicularly from the edge guide 34 into the input 12. The pick guide 35 is a substantially vertically oriented plate and includes an upper tapered pick plate 36 and a lower tapered pick plate 37. The upper pick plate 36 directs media being inserted into the input 12 toward the rear wall 22 for proper media positioning and aids with alignment of the photo media. The lower pick plate 37 is tapered to aid in directing the photo media being picked from the media input 12. More specifically, the lower pick plate 37 directs photo media into a print zone. The pick guide 35, including upper and lower pick plates 36, 37 which in combination define a U-shaped guide which aids in media feeding.

Adjacent the edge guide 34 is a slide housing 40 which is a generally flat plate and may comprise various shapes. Regardless of the shape utilized the slide housing 40 has an ACM shaft aperture 42 through which the ACM shaft 62 can pass. The slide housing 40 is generally disposed in a stationary position relative to the edge guide 30. The slide housing 40 further includes a first upper spring housing or collar 44 and a second lower spring housing or collar 46. The upper and lower spring housings 44, 46 are substantially cylindrical in shape and extend from a surface of the slide housing 40 away from the edge guide 34. The spring housings 44, 46 include preselected internal diameters based on the spring sizes utilized.

Extending from the first spring housing 44 is an upper guide 48 and extending from the lower housing 46 is a lower guide 49. The upper guide 48 and the lower guide 49 are also cylindrical in shape and are coaxial with the spring housings 44, 46. The upper and lower guides 48, 49 have a preselected internal diameter smaller than the spring housings diameters defining a step from the housings 44, 46 to the guides 48, 49 against which springs 70, 72 are seated. One of ordinary skill in the art will realize that alternate cross-sectional shapes may be utilized for the housings 44, 46 and the guides 48, 49 so long as the shapes allow for the structure and movement described herein.

As shown in FIG. 4, a plurality of notches or open-ended slots 45 extend axially through the first spring housing and second spring housing 44, 46 and the upper and lower guides 48, 49 with the open end of the notches being at the distal ends of the housings and guides. The notches allow the spring housings 44,46 and guides 48, 49 to flex and therefore partially expand when necessary as will be described further herein.

Extending from a surface of the edge guide 34 closest to the slide housing 40, is a first upper post 52 and a second lower post 54. The upper and lower posts 52, 54 are generally cylindrical in shape so as to extend through the corresponding first spring housing 44 and second spring housing 46 and upper and lower guides 48, 49. However, the upper and lower posts 52, 54 may alternatively have other shapes which coincide with alternate shapes of the spring housings and guides. The upper post 52 and lower post 54 are axially aligned with the upper and lower spring housings 44, 46 and also with the upper and lower guides 48, 49. At distal ends of the upper and lower posts 52, 54 are radially extending locking protuberances 56. As the locking protuberances 56 move through the spring housings 44, 46 and the guides 48, 49, the notches 45 allow the housings 44, 46 and guides 48, 49 to enlarge allowing for the passage of the locking protuberances 56 therethrough. Once the locking protuberances 56 pass through the upper and lower guides 48, 49 the guides return to their original diameter and the protuberances maintain a locked connection between the edge guide 34 and the slide housing 40 so that the edge guide assembly 30 is locked together but with the edge guide assembly still being moveable therein. The length of the posts 52, 54 and positions of the protuberances 56 define the distance that the edge guide can be biased away from the slide housing 40 in the direction of the stationary edge 24.

Figure 5:
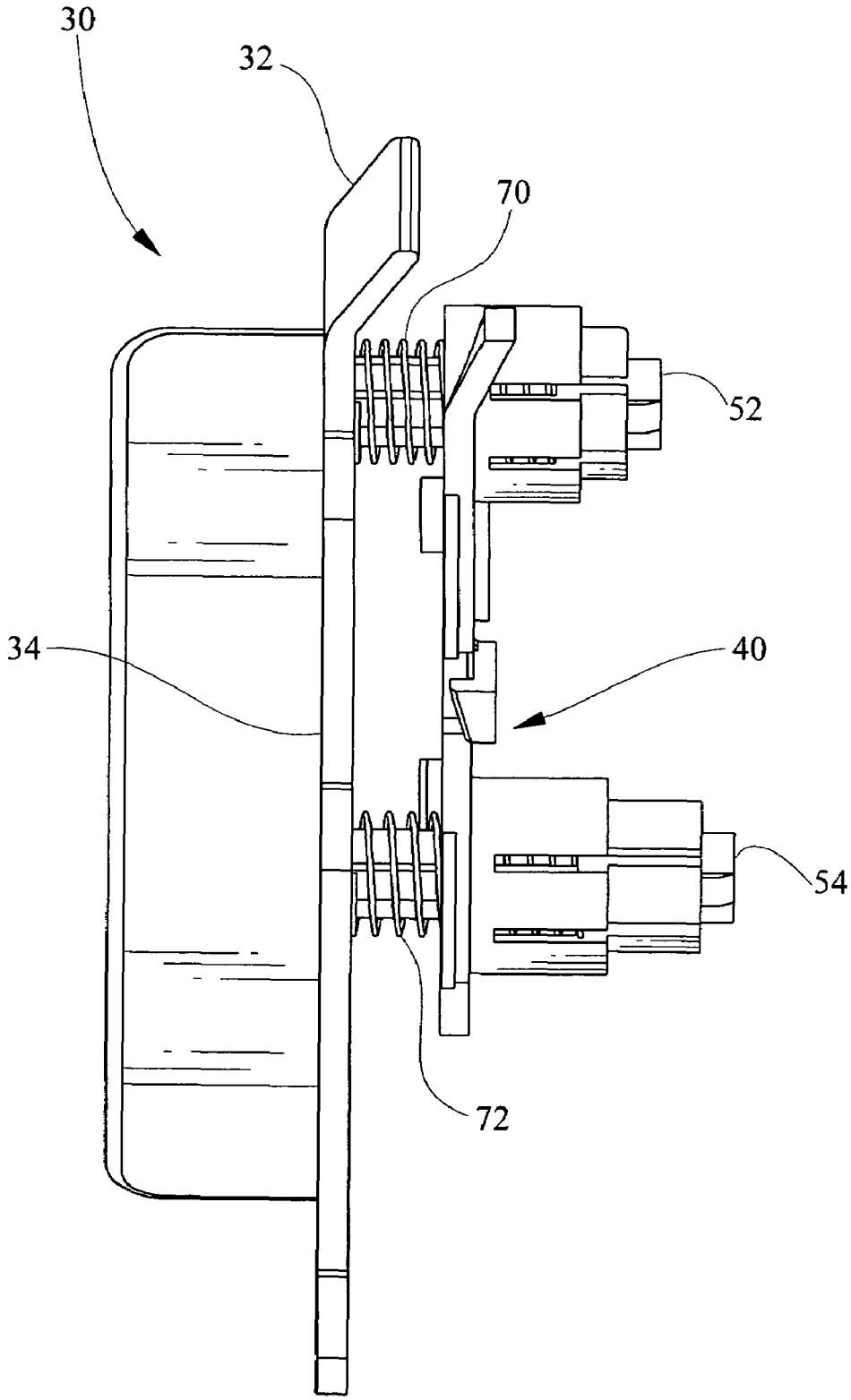
FIG. 5 is a rear view of the edge guide assembly of FIG. 4.

Referring now to FIG. 4 and FIG. 5, which depicts a rear view of the edge guide assembly 30, upper and lower springs 70,72 are disposed between the edge guide 34 and the slide housing 40. The springs 70, 72 are axially aligned with the upper post 52 and lower post 54, respectively. The upper and lower springs 70, 72 are seated at one end against the surface of the edge guide 34 facing the slide housing 40. The opposite ends of the upper and lower springs 70, 72 extend through the upper and lower spring housings 44, 46, respectively, and engage the smaller diameter of the upper guide 48 and lower guide 49, respectively. With the springs 70, 72 seated in the stationary housing 40, a biasing force is exerted on the edge guide 34. As shown in FIGS. 4 and 5, the upper and lower springs 70, 72 are in a substantially relaxed position and exert only a small force on the edge guide 34 so that the edge guide is positioned as shown in FIG. 2. According to the present embodiment the upper spring 70 exerts a larger spring force than the lower spring 72. The larger spring force exertion on the upper portion of the edge guide 34 insures that the posts 52, 54 and respective guides 48, 49 do not bind when photo media is inserted into the paper input 12 (FIG. 7) since a larger component force will be placed on the upper spring 70. According to one exemplary embodiment, the upper spring 70 may exert a force of about 10-15 grams and the lower spring may exert a force of about 5-10 grams in order to inhibit binding when media is inserted at the upper portion of the edge guide 34.

Figure 6:
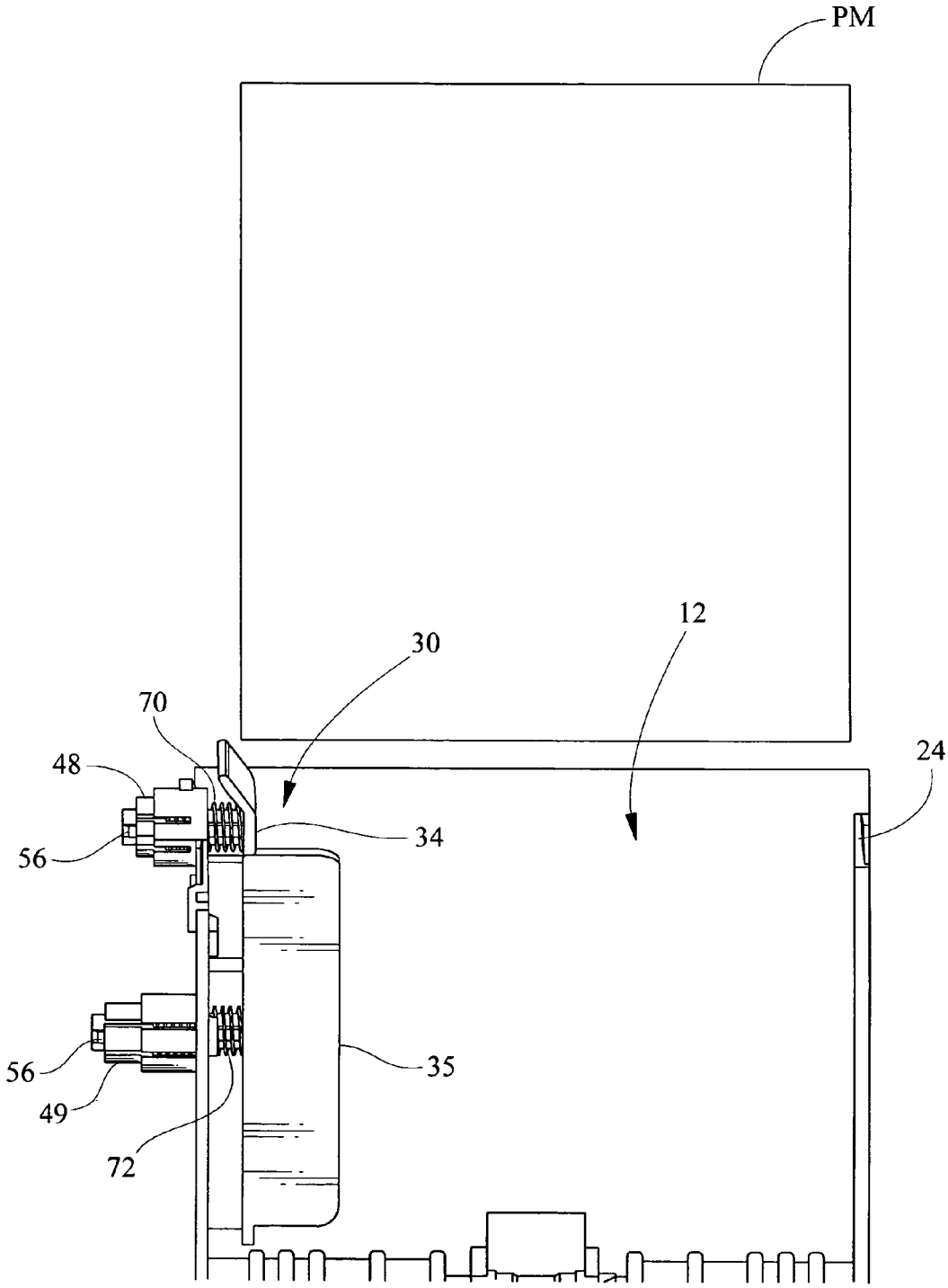
FIG. 6 is a front view of the edge guide assembly of FIG. 4 prior to being engaged by a media sheet.
Figure 7:
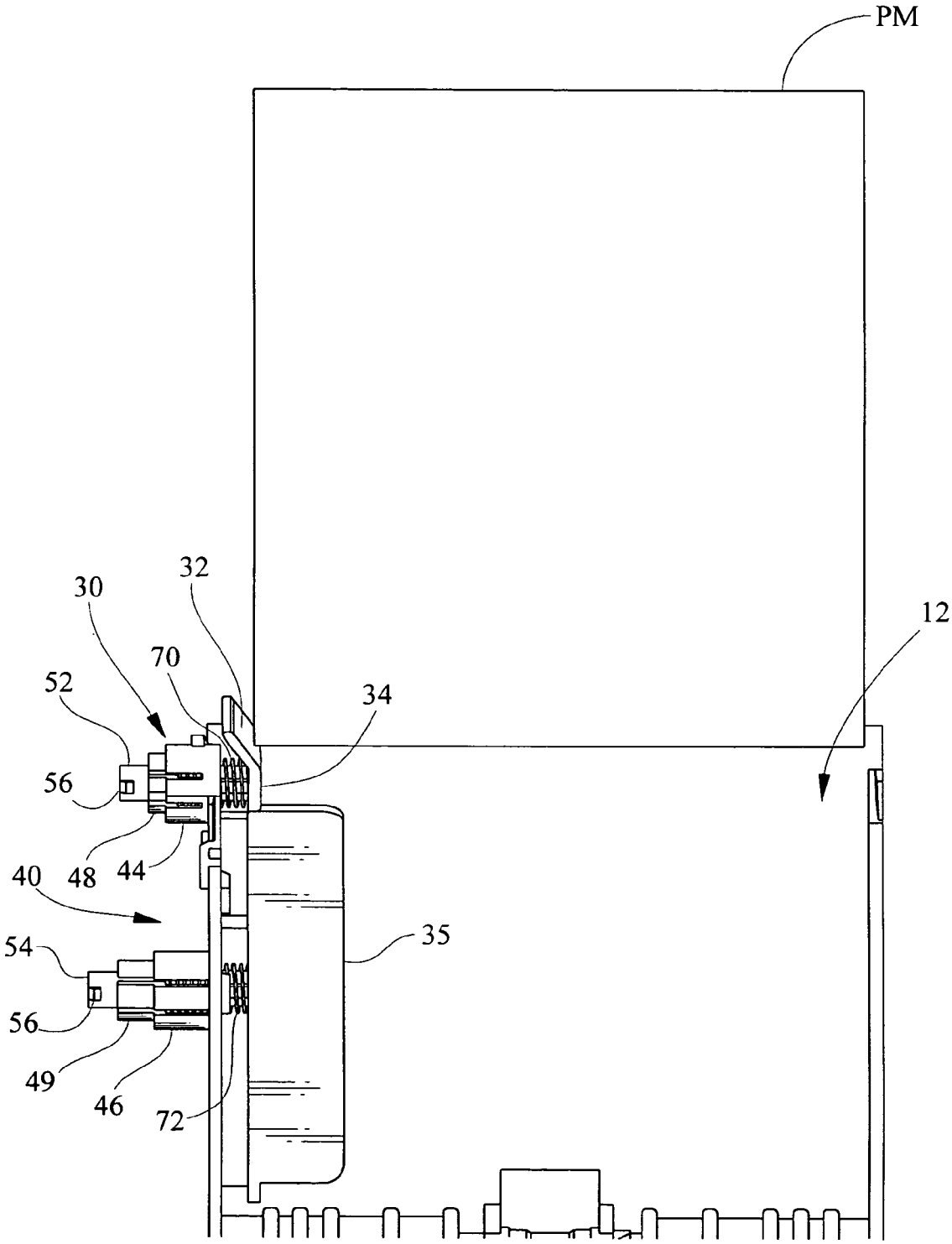
FIG. 7 is a front view of the edge guide assembly of FIG. 4 partially engaged by the media sheet of FIG. 6; and, FIG. 8 is a front view of the edge guide assembly of FIG. 4 fully engaged by the media sheet of FIG. 7.
Figure 8:
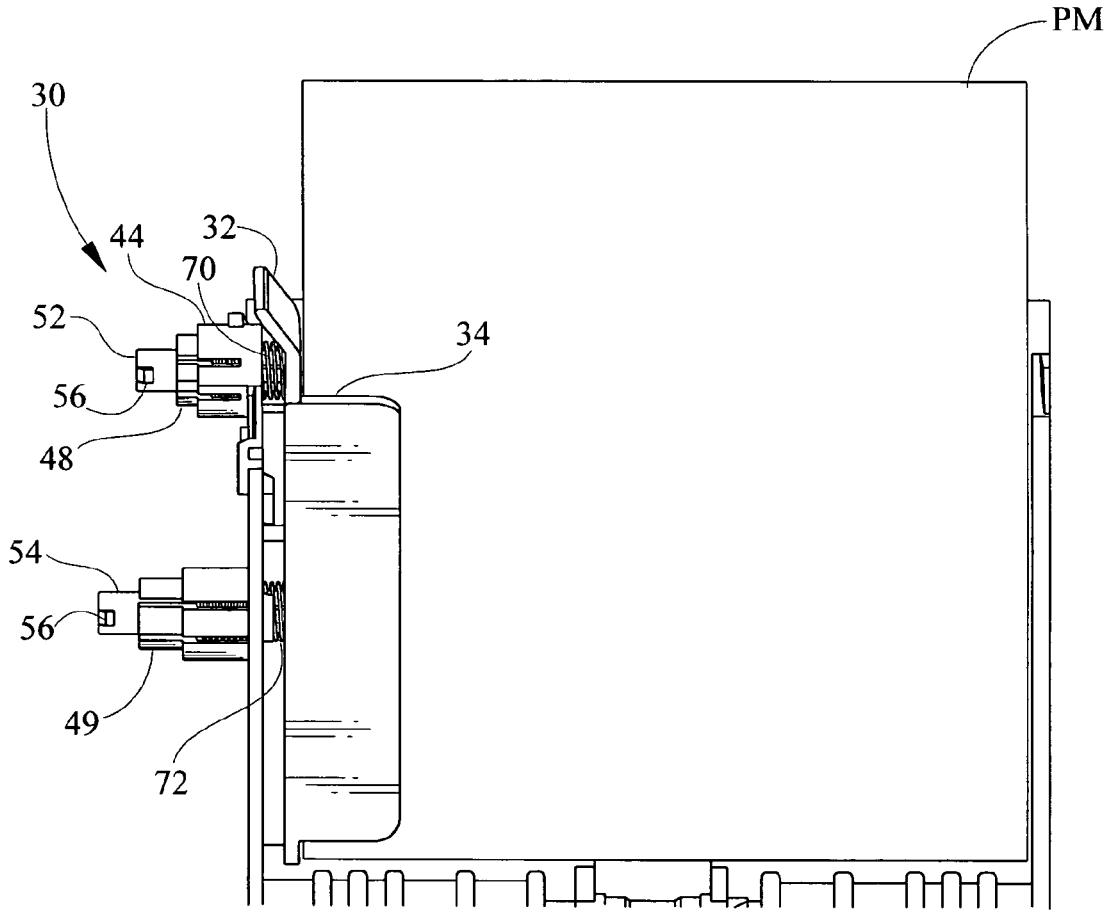

Referring now to FIGS. 6-8, which depict the operation of the edge guide assembly 30, the edge guide 34 is biased by the upper and lower springs 70, 72 toward an innermost position within the media input 12. With the springs 70, 72 biasing the edge guide 34 to an inner most position, the locking protuberances 56 are engaging the upper guide 48 and the lower guide 49. From this position the edge guide assembly 30 is ready to receive photo media PM and urge the photo media PM toward the opposite stationary guide member 24.

Referring now to FIG. 7, the photo media PM is shown engaging the edge guide assembly 30. It will be appreciated that media having overall dimensions that differ from those of photo media PM illustrated herein can be used with devices incorporating the subject invention, provided that, any differences in between the sizes of such media varies within a limited range, for example 8½ by 11 inch paper and A4 paper. Specifically, the photo media PM is depicted engaging the tapered lead-in surface 32 so that the edge guide 34 and the pick guide 35 are forced outwardly and slightly compressing the upper spring 70 and lower spring 72. The edge guide 34 automatically widens to a width within a preselected range, as shown the width of the photo media PM, when the tapered lead-in surface 32 is engaged by the photo media PM allowing the photo media PM to move into the media input 12. With the edge guide moved outwardly and the upper and lower springs 70, 72 slightly compressed, the upper and lower posts 52, 54 are depicted extending further from the upper and lower guides 48, 49 respectively. As previously indicated, the lower spring 72 has a decreased spring force as compared to the upper spring 70 so that as media is inserted as depicted in FIG. 7, the upper and lower posts 52, 54 do not bind. Were the upper and lower spring forces equal, the upper spring would compress, but not the lower spring which would result in binding between the slide housing 40 and edge guide 34. Otherwise stated, the lesser spring force of the lower spring 72 allows the lower post 54 to move through the lower guide 49 when the media engages the tapered lead-in 32 and the upper spring 70 is compressed.

Referring now to FIG. 8, the media is shown advancing from its position in FIG. 7 and engaging the entire length of the edge guide 34. The springs 70, 72 are compressed further than in FIG. 7. Moreover a distributed load is placed upon the media due to the spring force provided by the upper spring 70 and the lower spring 72. As a result, the guide 34 forces the media to the opposite side of the media input 12 and against the stationary edge guide member 24. Through the aforementioned design and function the edge guide assembly 30 automatically aligns two parallel edges of media extending in the feed direction without manual intervention.

The foregoing description of the exemplary embodiment of the invention has been presented for purposes of illustration. It is not intended to be exhaustive or to limit the invention to the precise forms disclosed, and obviously many modifications and variations are possible in light of the above teaching. It is intended that the scope of the invention be defined by the following claims.

What is claimed is:

1. An edge guide assembly, comprising:

a media input;

a slide housing mounted within said media input;

an edge guide slidably connected to said slide housing;

said edge guide biased by a first biasing force and a second biasing force, wherein said first force is greater than said second force;

a first and second collar extending from a surface of said slide housing;

a first spring and a second spring disposed in said first collar and said second collar, respectively.

2. The edge guide assembly of claim 1 further comprising first and second guides extending from first and second spring housings, respectively.

3. The edge guide assembly of claim 1 wherein said edge guide further comprises a pick guide extending substantially perpendicularly from said edge guide.

4. The edge guide assembly of claim 1 further comprising:

said slide housing having at least two apertures therethrough; and first and second posts extending from said edge guide and slidably received in through said apertures.

5. The edge guide assembly of claim 1 wherein said edge guide automatically adjusts to receive a media within a predetermined range of widths.

6. The edge guide assembly of claim 1, wherein said edge guide assembly automatically aligning parallel edges of a media.

7. The edge guide assembly of claim 1 further comprising a pick guide having a substantially U-shaped cross-section extending from said edge guide.

8. In a peripheral device having a media input for receiving a media stack, said media input having at least two sides, an edge guide assembly for aligning edges of said media stack, comprising:

a stationary slide housing and an edge guide disposed in one of said at least two sides of said media input;

said edge guide being slidably disposed relative to said slide housing;

said slide housing having at least one collar extending from a surface of said slide housing and axially aligned with at least one post extending from said edge guide for slidable movement of said at least one post through said at least one collar; and, at least one spring having a first end and a second end said first end of said at least one spring disposed within said at least one collar and engaging said edge guide at said second end for biasing and slidably disposing said edge guide relative to said slide housing.

9. The edge guide of claim 8 wherein said at least one collar further comprises an upper collar and a lower collar.

10. The edge guide assembly of claim 8 wherein said at least one post further comprises an upper post and a lower post.

11. The edge guide assembly of claim 8 further comprising a tapered lead-in surface extending from said edge guide.

12. The edge guide assembly of claim 8 wherein said at least one spring further comprises an upper spring and a lower spring.

13. The edge guide assembly of claim 12, said upper spring having a greater biasing force than said lower spring.

14. The edge guide assembly of claim 8 further comprising said edge guide having a pick guide for compressing said media stack.

15. The edge guide assembly of claim 8, said edge guide biasing said media stack to one of said at least two sides of said media input.

16. The edge guide assembly of claim 8 wherein said edge guide translates relative to the slide housing in a direction perpendicular to a direction of media movement through the peripheral device.

17. The edge guide assembly of claim 8 further comprising said edge guide automatically adjusting to receive said media stack within a preselected size range.

18. The edge guide assembly of claim 8 further comprising automatically aligning parallel edges of said media stack.

19. An edge guide assembly for a peripheral device, comprising:

a peripheral device, said peripheral device having an opening for receiving media sheets within a preselected size range comprising a first side and a second side opposite said first side;

said first side of said opening comprising a stationary guide member;

said second side of said opening comprising:

a slide housing having upper and lower collars extending from a surface of said slide housing;

an edge guide having upper and lower posts slidably extending through said upper and lower collars, respectively said upper and lower posts movable relative to said upper and lower collars from a first position to a second position; and an upper spring disposed within said upper collar and about said upper post engaging said edge guide;

a lower spring disposed within said lower collar and about said lower post engaging said edge guide;

said upper and lower springs disposed between said slide housing and said edge guide for biasing said edge guide toward said stationary edge member.

20. The edge guide assembly of claim 19 further comprising said edge guide having a tapered lead-in surface for insertion of media into the peripheral device.

21. The edge guide assembly of claim 19 further comprising said upper spring having a larger spring force acting on said edge guide before said lower spring to inhibit binding of said upper post and lower post as media is positioned in said opening of said peripheral device.

22. The edge guide assembly of claim 1 wherein said upper and lower springs are seated in said collars.

23. The edge guide assembly of claim 1 further comprising each of said upper and lower posts having a radially extending protuberance at distal ends thereof and each of said upper and lower collars having a plurality of axially extending, open ended slots therein.

24. The edge guide assembly of claim 1 further comprising said edge guide automatically aligning said media sheets.

25. The edge guide assembly of claim 1 further comprising said edge guide defined by a plate having a tapered lead-in surface and a substantially perpendicular pick guide.

26. The edge guide assembly of claim 25 wherein said pick guide comprises a tapered surface for compressing said media sheets.

27. The edge guide assembly of claim 1 further comprising a substantially U-shaped pick guide extending from said edge guide, said substantially pick guide U-shaped pick guide having upper and lower tapered portions.

* * * * *